US006097750A

United States Patent [19]

Knudsen et al.

[11] Patent Number: 6,097,750

[45] Date of Patent: Aug. 1, 2000

[54] ELECTROSLAG REFINING HEARTH

[75] Inventors: Bruce Alan Knudsen, Amsterdam; Peter George Frischmann, Ballston Spa; Robert John Zabala, Schenectady; Mark Gilbert Benz, Burnt Hills; William Thomas Carter, Jr., Galway, all of N.Y.

[73] Assignee: General Electric Company, Schenectady, N.Y.

[21] Appl. No.: 09/001,077

[22] Filed: Dec. 31, 1997

[51] Int. Cl.[7] ..... H05B 6/22

[52] U.S. Cl. ..... 373/156; 373/142

[58] Field of Search ..... 373/42, 43, 44, 373/45, 56, 59, 72, 79, 83, 142, 156, 3, 4; 75/10.14, 10.25, 10.24, 10.18

[56] References Cited

U.S. PATENT DOCUMENTS

| | | | |
|---|---|---|---|
| 1,227,069 | 5/1917 | Reid | 373/3 |
| 1,463,970 | 8/1923 | Pope | 373/59 |
| 1,684,800 | 9/1928 | Maximoff et al. | 373/156 |
| 3,582,528 | 6/1971 | Seale et al. | 373/156 |
| 4,738,713 | 4/1988 | Stickle et al. | 75/10.18 |
| 5,058,127 | 10/1991 | Garnier et al. | 373/157 |
| 5,121,406 | 6/1992 | Hugo et al. | 373/142 |
| 5,160,532 | 11/1992 | Benz et al. | 75/10.24 |
| 5,310,165 | 5/1994 | Benz et al. | 266/201 |
| 5,325,906 | 7/1994 | Benz et al. | 164/270.1 |
| 5,332,197 | 7/1994 | Benz et al. | 266/201 |
| 5,348,566 | 9/1994 | Benz et al. | 75/10.24 |
| 5,366,206 | 11/1994 | Benz et al. | 266/202 |
| 5,394,432 | 2/1995 | Fukuzawa et al. | 373/156 |
| 5,479,438 | 12/1995 | Blum et al. | 373/156 |
| 5,563,904 | 10/1996 | Colpo et al. | 373/146 |

FOREIGN PATENT DOCUMENTS 2265805 10/1993 United Kingdom .

*Primary Examiner*—Tu Ba Hoang
*Attorney, Agent, or Firm*—Ernest G. Cusick; Noreen C. Johnson

[57] ABSTRACT

A cold hearth for an electroslag refining crucible includes a floor above which a melt pools. The floor includes a drain for draining the melt by gravity. A plug is deployed inside the drain to block discharge of the melt therethrough, and an actuator is attached to the plug for withdrawing the plug from the drain to permit drainage of the melt upon startup.

13 Claims, 3 Drawing Sheets

ELECTROSLAG REFINING HEARTH

BACKGROUND OF THE INVENTION

The present invention relates generally to electroslag refining, and, more specifically, to electroslag refining of superalloys.

Electroslag refining (ESR) is a process used to melt and refine a wide range of alloys for removing various impurities therefrom. U.S. Pat. No. 5,160,532—Benz et al. discloses a basic electroslag refining apparatus over which the present invention is an improvement. Typical superalloys which may be effectively refined using electroslag refining include those based on nickel, cobalt, zirconium, titanium, or iron, for example. The initial, unrefined alloys are typically provided in the form of an ingot which has various defects or impurities which are desired to be removed during the refining process to enhance metallurgical properties thereof including oxide cleanliness, for example.

In a conventional electroslag apparatus, the ingot is connected to a power supply and defines an electrode which is suitably suspended in a water cooled crucible containing a suitable slag corresponding with the specific alloy being refined. The slag is heated by passing an electric current from the electrode through the slag into the crucible, and is maintained at a suitable high temperature for melting the lower end of the ingot electrode. As the electrode melts, a refining action takes place with oxide inclusions in the ingot melt being exposed to the liquid slag and dissolved therein. Droplets of the ingot melt fall through the slag by gravity and are collected in a liquid melt pool at the bottom of the crucible. The slag, therefore, effectively removes various impurities from the melt to effect the refining thereof.

The refined melt may be extracted or drained from the crucible by a conventional segmented, cold-wall induction-heated guide (CIG). The refined melt extracted from the crucible in this manner provides an ideal liquid metal source for various solidification processes including, for example, powder atomization, spray deposition, investment casting, melt-spinning, strip casting, and slab casting.

In the exemplary electroslag apparatus introduced above, the crucible is conventionally water-cooled to form a solid slag skull on the surface thereof for bounding the liquid slag and preventing damage to the crucible itself as well as preventing contamination of the ingot melt from contact with the parent material of the crucible, which is typically copper. The bottom of the crucible typically includes a water-cooled, copper cold hearth in funnel form upon which a solid skull of the refined melt forms for maintaining the purity of the collected melt at the bottom of the crucible. The CIG defines a drain through the cold hearth and includes an upper funnel portion matching the funnel hearth, and a discharge drain tube or downspout therebelow, and is also typically made of copper, segmented, and water-cooled for also allowing the formation of a solid skull of the refined melt for maintaining the purity of the melt as it is extracted from the crucible.

An induction heater including a water-cooled electrical coil surrounds the guide tube for inductively heating the melt thereabove for controlling skull thickness. In this way, the thickness of the skull formed inside the drain may be controlled and suitably matched with melting of the ingot for obtaining a substantially steady state production of refined melt which is drained by gravity through the downspout.

In order to achieve steady state operation of the electroslag refining apparatus, the apparatus must be suitably started without introducing undesirable contamination or impurities. In a conventional cold start method, a solid starter plate is fixed into position at the bottom of the crucible and above the discharge guide tube.

Conventional slag in particulate form is deposited atop the starter plate around the electrode. An electrical current is passed through the electrode to the starter plate and then through the atmosphere to cause an electrical arc to jump therebetween. The heat from the arc melts the surrounding solid slag. When sufficient slag is melted, the electrode is lowered into the slag to extinguish the arc, at which time power to the electrode effects direct resistance heating of the slag pool for increasing its temperature.

The heated slag pool then continues to melt the tip of the electrode and the starter plate until a hole is melted through the starter plate and liquid metal begins to fill the crucible atop the guide tube. The induction heater is operated to initially allow the skull to plug the downspout to prevent premature draining of the melt until sufficient refining has occurred. The hole through the starter plate enlarges until it reaches the outer perimeter of the plate and the resulting refined metal and slag skulls line the crucible and the guide tube, and the refined melt pool is ready for draining The induction heater surrounding the downspout is then used to heat and melt the plug to commence and control draining. Steady state operation may begin when sufficient melt height is achieved in the crucible, and the rate of melting of the electrode and discharge flowrate from the guide tube are substantially equal.

However, induction heaters are expensive, especially when separate heaters are provided for the downspout and funnel portions of the CIG.

Accordingly, it is desired to provide a less expensive electroslag refining cold hearth and method of ESR starting.

SUMMARY OF THE INVENTION

A cold hearth for an electroslag refining crucible includes a floor above which a melt pools. The floor includes a drain for draining the melt by gravity. A plug is deployed inside the drain to block discharge of the melt therethrough, and an actuator is attached to the plug for withdrawing the plug from the drain to permit drainage of the melt upon startup.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
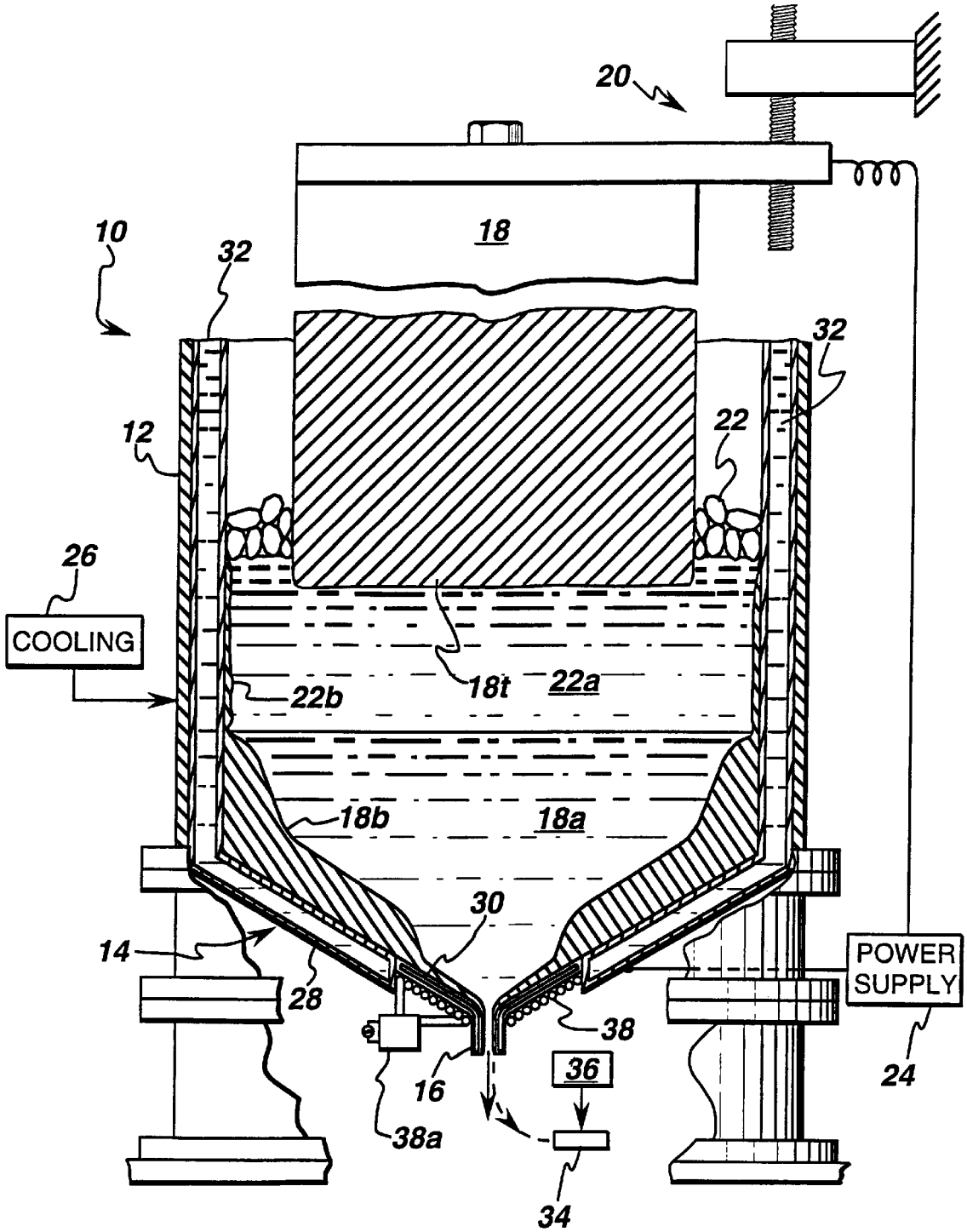
FIG. 1 is a schematic representation of an electroslag refining apparatus having an improved cold hearth in accordance with an exemplary embodiment of the present invention.

Illustrated schematically in FIG. 1 is an electroslag refining apparatus 10 in accordance with an exemplary embodiment of the present invention. The apparatus 10 includes a cylindrical upper crucible 12 and a conical lower cold hearth 14 extending therebelow. The hearth 14 includes a central drain 16 extending downwardly.

Suitably suspended in the crucible 12 is an ingot 18 of a suitable alloy for undergoing electroslag refining. Conventional means 20 are provided for feeding or lowering the ingot 18 into the crucible 12 at a suitable feed rate. The lowering means 20 may have any suitable form including a drive motor and transmission rotating a screw, which in turn lowers or translates downwardly a support bar fixedly joined at one end to the top of the ingot 18.

The ingot 18 is formed of any suitable alloy requiring electroslag refining such as the superalloys listed above. A suitable slag 22 is provided inside the crucible 12 and may take any conventional composition for refining a specific material of the ingot 18.

The ingot 18 includes a tip 18*t* at its lower end, and conventional means 22 are provided for melting the ingot tip 18*t* as it is lowered and fed into the crucible 12. The tip melting means 24 is in the exemplary form of a suitable alternating or direct current power supply electrically joined to the ingot 18 through its support bar by a suitable electrical lead. Electrical current is carried through the ingot 18, which defines an electrode, and through the slag, in liquid form 22*a,* to the crucible 12, with a return electrical lead to the power supply. In this way, the means 24 are effective for powering the ingot electrode 18 to effect resistance heating of the slag in its liquid form to a suitably high temperature to melt the electrode tip 18*t* suspended therein for consuming the electrode 18 as it is lowered during the electroslag refining process.

Suitable means 26 are provided for cooling the crucible 12, and the cold hearth 14, from the heat generated during the refining process. The crucible and hearth may take any conventional form including hollow copper jackets disposed in flow communication with the cooling means 26 which circulate therethrough cooling water 32 for removing heat therefrom. The cooling means 26 therefore include a suitable circulating pump and heat exchanger for removing heat as the water is circulated through the jackets.

The slag is initially in solid form and is initially melted in a startup process using a starter plate (not shown) as described above to develop a molten slag pool 22*a*. The slag pool undergoes resistance heating as electrical current passes from the electrode 18 through the slag pool and to the crucible 12 in the electrical path to the power supply 24. The temperature of the slag pool is thereby increased to melt the electrode tip 18*t* which forms a pool of refined ingot material, melt 18*a,* below the slag pool 22*a.*

The refined pool 18*a* is denser than the slag pool 22*a,* and as the ingot electrode 18 is consumed at its tip by melting thereof, the melt travels downwardly through the slag pool which removes impurities therefrom for effecting electroslag refining, with the refined pool accumulating the refined melt therein. Since the crucible and hearth are water cooled, corresponding slag and refined metal skulls 22*b,* 18*b* develop over the entire submerged inner surfaces thereof to provide a continuous lining separating the copper members from the refined melt pool and slag pool. This prevents contamination of the refined pool from the copper crucible, hearth, and drain themselves.

The refined melt discharged through the drain 16 may then be used for any suitable application including, for example, powder atomization, spray deposition, investment casting, melt-spinning, strip casting, and slab casting.

In the basic ESR apparatus described above, the crucible drain 16 is in the form of a downspout orifice in a circumferentially segmented, cold-wall induction-heated guide (CIG) 30 to prevent undesirable plugging of the drain 16 during steady state operation. The CIG must be cooled against the substantial heat of the melt, yet induction energy is also required to prevent the melt skull from closing the drain 16.

Accordingly, previous designs have included one or more induction heaters surrounding the various portions of the CIG to preferentially heat the melt channeled therethrough. Since induction heaters are expensive, it is desired to reduce their need without adversely affecting performance of ESR. In particular, it is desired to eliminate the need for local induction heating around a portion of the drain 16 during startup of the ESR apparatus.

Figure 2:
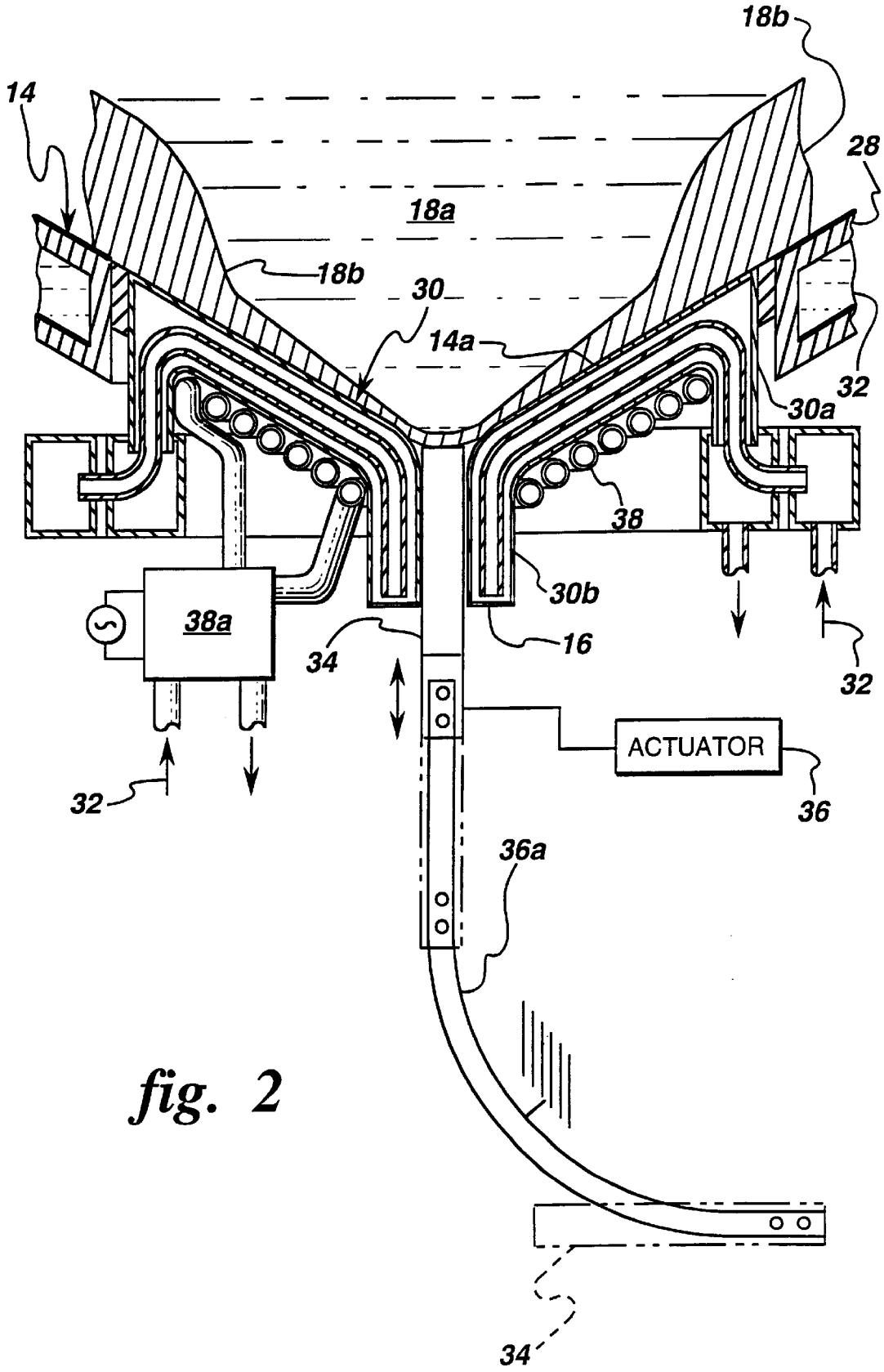
FIG. 2 is a an enlarged section view of a portion of the hearth illustrated in FIG. 1 including a plug deployed in a downspout thereof.
Figure 3:
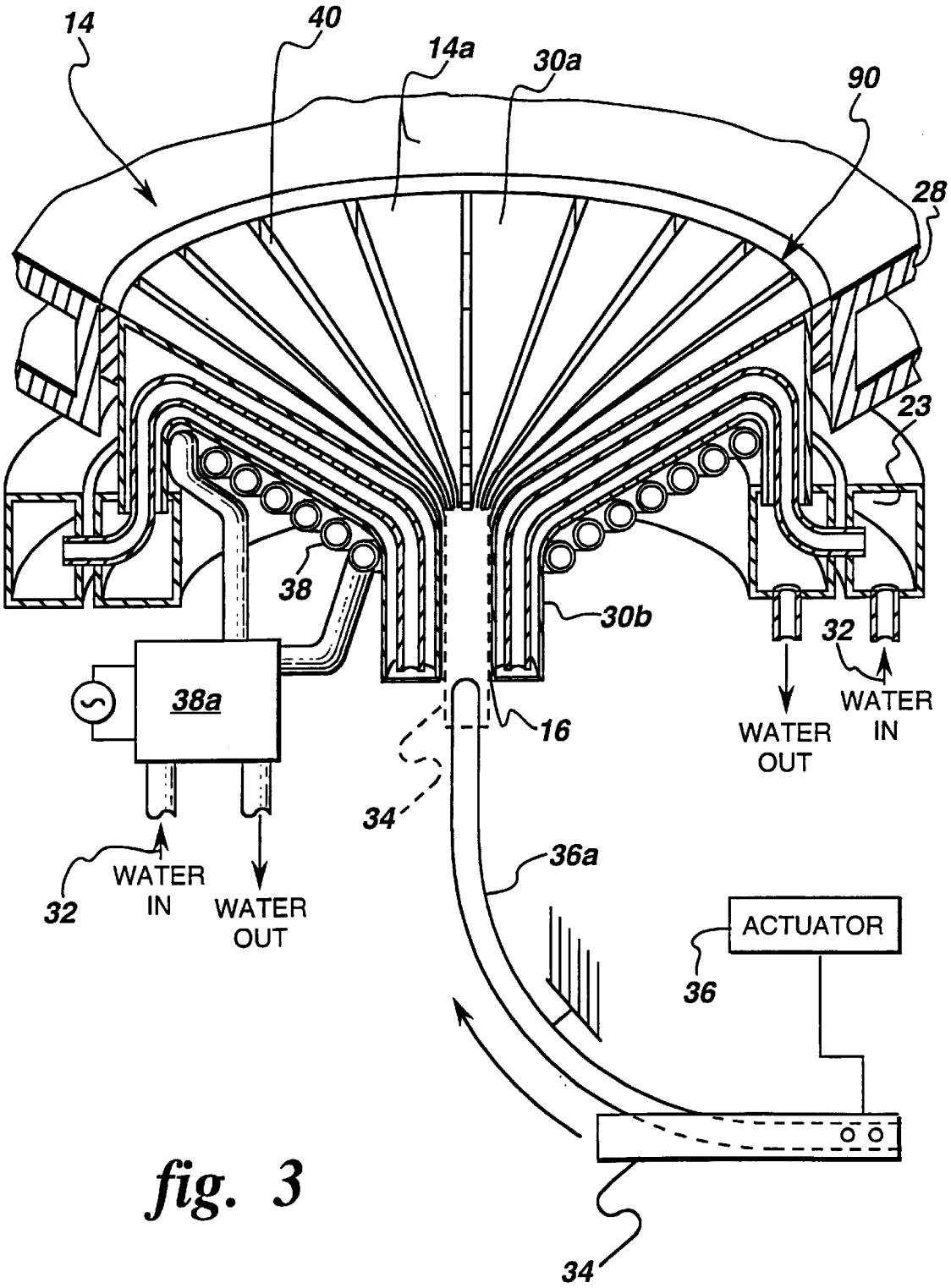
FIG. 3 is a an enlarged section view of a portion of the hearth illustrated in FIG. 1 including the plug withdrawn from the downspout thereof.

In accordance with a preferred embodiment of the present invention as illustrated generally in FIG. 1, and in more particularity in FIG. 2, an improved cold hearth 14 is provided at the bottom of the crucible for starting and draining the melt during operation. FIG. 2 illustrates a portion of the hearth 14 during startup with the melt and melt skull thereatop, whereas FIG. 3 is a similar figure without the melt and skull being shown for clarity of presentation.

As initially shown in FIG. 2, the cold hearth 14 is preferably conical with a radially outer conical rim 28 suitably joined to the lower end of the crucible 12, and a central conical portion defined by the cold-wall induction-heated guide (CIG) 30 including the drain 16 therein. The rim 28 may take any conventional form including a jacket or channel in common with the crucible 12 in which a coolant 32, such as water, is circulated by the common cooling means 26. But for the present invention, the CIG 30 may also be conventionally configured and cooled using a suitable coolant such as water circulated therethrough.

The cold hearth 14 includes a floor 14*a* for the crucible above which the refined melt accumulates or pools during operation. The crucible floor 14*a* is defined by the upper conical surfaces of the rim 28 and CIG 30 and is cooled by the coolant circulated therethrough. The drain 16 is preferably disposed in the center of the crucible floor 14*a* through the CIG 30 for draining the melt by gravity during operation.

In accordance with the present invention, means in the form of a solid plug 34 is removably positioned inside the drain 16 to block discharge of the melt therethrough during startup. Additional means in the form of a drive actuator 36 are mechanically attached or joined to the plug 34 for initially deploying the plug during startup and then withdrawing the plug for subsequent steady state operation.

The use of a discrete plug 34 allows simplification of the cold hearth 14, in particular the CIG 30, and allows an improved method of starting the ESR apparatus. During startup, the actuator 36 is operated for mechanically deploying the plug 34 inside the drain 16 to block discharge of the melt until the melt is sufficiently refined to commence draining. At such time, the actuator 36 is again operated for mechanically withdrawing the plug 34 from the drain 16 to permit drainage of the melt therethrough without obstruction by the removed plug.

As indicated above, the apparatus may be initially cold started using a conventional starter plate (not shown) which completely covers the cold hearth 14. The plug 34 may then be initially deployed inside the drain 16 before producing any melt. The ingot 18 illustrated in FIG. 1 may be disposed adjacent the starter plate for developing an electrical arc therebetween to generate heat to start the melting and refining process. The starter plate itself is also melted and is eventually consumed over its center portion for allowing the melt to accumulate atop the cold hearth 14 as illustrated in FIG. 2. The plug 34 blocks the melt from discharging through the drain 16 until a sufficient level of melt is accumulated in the crucible to ensure that the melt is adequately refined and separated from the liquid slag. The plug 34 is then withdrawn from the drain 16 for allowing the melt to discharge by gravity without obstruction.

As illustrated in FIG. 2, the drain 16 preferably comprises a vertical downspout having a central orifice, and the plug 34 is in the form of a complementary elongate rod which extends upwardly through the downspout in the deployed position illustrated. In this way, the entire height or length of the drain 16 is blocked by the removable plug 34. In the preferred embodiment, the plug 34 includes an upper tip which is disposed preferably level with the crucible floor 14*a* at the entrance to the drain 16 in the deployed position.

Since the melt has a high melting temperature of about 1300° C., for example, the plug 34 is preferably formed of a different material having a suitably high melting temperature to protect it from melting during operation. For example, the plug may be formed of tungsten for suitably withstanding the heat of the melt without itself melting. The plug 34 itself is suitably protected by the surrounding downspout which provides a heat sink for withdrawing heat. During operation, a thin portion of the melt skull may form atop the tip of the plug to prevent draining of the melt while protecting the melt from contamination by the plug itself.

In the preferred embodiment illustrated in FIG. 2, the plug 34 extends upwardly into the drain 16, and the actuator 36 is disposed below the drain 16 for withdrawing the plug downwardly to a withdrawn and stowed position suitably removed from the vicinity of the drain 16 to provide unobstructed discharge of the melt for subsequent use, such as in spray forming a billet. The plug 34 is preferably a cylindrical rod which is complementary with the tubular orifice defining the drain 16, and is sized to closely fit within the drain 16 to suitably block the drain 16 without being fixedly attached thereto.

The actuator 36 may take any conventional form for deploying and withdrawing the plug during operation. For example, the lower end of the plug as illustrated in FIG. 2 may include a pair of pins which act as cams disposed in a complementary grooved track 36*a* which defines the linear travel of the plug vertically upwardly into the drain 16 during deployment, and allows the plug to be similarly withdrawn and moved to the side and out of the way. The cooperating actuator 36 may include suitable linkages, belts, cables, chains, or similar elements for driving the plug 34 along the track between the deployed and withdrawn positions. In its simplest embodiment, the actuator 36 may be a pneumatic or hydraulic piston having an output rod attached coaxially with the plug for deploying and withdrawing the plug vertically in a straight line subject to available space.

As indicated above, the CIG 30 illustrated in FIGS. 2 and 3 may take any conventional form that is modified in accordance with the present invention for reducing its complexity and cost for cooperating with the plug 34. As best shown in FIG. 3, the CIG 30 includes a circumferentially segmented upper conical portion 30*a* which defines a center portion of the crucible floor 14*a*, and a tubular lower portion or downspout 30*b* defining the drain 16 therethrough. An induction heater 38 surrounds solely the guide upper portion 30*a* along the underside thereof for inductively heating the melt thereabove.

The CIG upper portion 30*a* illustrated in FIG. 3 is in the form of a plurality of circumferentially spaced apart fingers each having an internal channel therein for circulating the water coolant therethrough in a conventional manner. The fingers are separated by corresponding gaps 40 which may be air or gas filled or filled with a suitable electrically insulating material so that induction heating energy may be radiated through the gaps and into the melt for heating thereof during operation. The induction heater 38 may take any conventional form and includes an electrically conducting tubular coil joined to a suitable power and cooling supply 38*a*. The power supply 38*a* is conventional and includes an alternating current power source for providing electrical current through the induction heater coil. And the coolant is suitably circulated through the inside of the tubular coil for providing cooling during operation.

As illustrated in FIGS. 2 and 3, the induction heater 38 may be limited in extent to surround solely the guide upper portion 30*a* above most, if not all, of the downspout drain 16. In this way, the induction heater 38 is effective for inductively heating the melt above the drain 16 without inductively heating the melt inside the drain 16 upon withdrawal of the plug from the drain 16. The drain 16 is characterized by the absence of an induction heater therearound.

This may be contrasted with an otherwise conventional CIG 30 in which the downspout drain 16 itself is also surrounded by additional spirals of a common induction heater 38 or by an independent or separate induction heating coil. In the previous designs, an induction heater was required around the downspout 30*b* to provide additional energy or heating to melt the skull initially formed therein.

By using the discrete plug 34 inside the drain 16, the skull is prevented from forming inside the drain 16 itself and therefore does not require melting thereof to open the drain 16. By simply withdrawing the plug after startup, the latent heat of fusion within the melt itself is sufficient for melting the thin skull formed atop the plug and above the drain 16 during startup which allows the melt to flow freely through the drain itself. This permits the elimination of the additional induction heating coils around the downspout 30*b* itself. The induction heater 38 may now be made as small as practical for locally heating the melt within the vicinity of the conical portion of the CIG 30. This in turn substantially reduces complexity and cost of the CIG 30.

The induction heater 38 remaining above the drain 16 may be conventionally operated for locally heating the melt above the drain to ensure its flow through the drain without plugging therein. Internal cooling of the downspout 30*b* may be controlled for developing a relatively thin skull inside the drain 16 for preventing contamination of the draining melt without completely blocking the drain during steady state operation.

The height of the drain 16 may be selected in combination with the amount of heating from the induction heater 38 above the drain and the amount of cooling inside the downspout 30*b* for allowing flow of the melt without blocking the drain during steady state operation. The amount of induction heat and downspout cooling may also be used to control the thickness of the skull formed inside the drain and thereby control the discharge flowrate during operation.

Once withdrawn from the drain 16 at the startup, the plug 34 is no longer required for steady state operation of the ESR apparatus until a new startup and steady state cycle are required. This requires a suitable amount of disassembly of the apparatus to remove the consumed starter plate and replace it with a new starter plate.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. An electroslag refining apparatus for refining an alloy, the apparatus comprising:

an electroslag refining crucible having a segmented conical cold hearth;

said hearth includes a floor at its central conical portion for receiving a melt pool;

a cold-wall induction-heated drain having an upper portion and a tubular downspout in said floor for draining said melt by gravity;

an elongated plug upwardly deployed inside said drain to block the entire length of said tubular downspout for stopping a discharge of said melt therethrough;

said tubular downspout is characterized by the absence of an induction heater; and an actuator attached to said plug for withdrawing said plug from said drain to permit draining of said melt therethrough.

2. An electroslag refining apparatus according to claim 1 wherein said downspout having a central orifice, and said plug extends upwardly through said downspout in a deployed position of the downspout.

3. An electroslag refining apparatus according to claim 2 wherein said plug includes an upper tip disposed at said crucible floor in said deployed position.

4. An electroslag refining apparatus according to claim 3 wherein said actuator is disposed below said drain for withdrawing said plug downwardly to a withdrawn position.

5. An electroslag refining apparatus according to claim 1 wherein said upper portion includes a plurality of circumferentially spaced apart fingers each having an internal channel for circulating a coolant therethrough.

6. An electroslag refining apparatus according to claim 5 wherein said plug is formed of a different material than said melt.

7. An electroslag refining apparatus for refining an alloy, the apparatus comprising: electroslag refining hearth and an electroslag refining crucible;

a floor for said crucible above which an electroslag refined melt pools;

a drain in said floor including a circumferentially segmented, cold-wall induction-heated guide comprising a tubular downspout for draining said melt by gravity;

a plug deployed inside said drain to block the entire length of said tubular downspout for stopping a discharge of said melt therethrough;

said tubular downspout is characterized by the absence of an induction heater; and an actuator attached to said plug for withdrawing said plug from said drain to permit draining of said melt therethrough.

8. An electroslag refining apparatus according to claim 7 wherein said downspout having a central orifice, and said plug is elongate and extends upwardly through said downspout in said deployed position.

9. An electroslag refining apparatus according to claim 8 wherein said guide includes an induction heater disposed above said downspout for inductively heating said melt thereabove.

10. An electroslag refining apparatus according to claim 9 wherein said plug includes an upper tip disposed at said crucible floor in a deployed position.

11. An electroslag refining apparatus according to claim 9 wherein said actuator is disposed below said drain for withdrawing said plug downwardly to a withdrawn position.

12. An electroslag refining apparatus for refining an alloy, the apparatus comprising:

an electroslag refining crucible having a cold hearth;

said hearth includes a floor for receiving a melt pool;

a drain in said floor for draining said melt by gravity;

a plug deployed inside said drain to block discharge of said melt therethrough; and an actuator attached to said plug for withdrawing said plug from said drain to permit draining of said melt therethrough, wherein said drain comprises a downspout having a central orifice, and said plug is elongate and extends upwardly through said downspout in a deployed position of the downspout, said plug comprises an upper tip disposed at said crucible floor in said deployed position, said actuator is disposed below said drain for withdrawing said plug downwardly to a withdrawn position, and the apparatus further comprising:

a cold-wall induction-heated guide including: a circumferentially segmented upper portion defining a central portion of said floor; a tubular lower portion defining said downspout and drain therein, an induction heater surrounding said guide upper portion for inductively heating said melt thereabove; and said tubular lower portion being characterized by the absence of an induction heater therearound.

13. An electroslag refining apparatus comprising:

an electroslag refining crucible having a hearth;

said hearth includes a floor for receiving an electroslag refined melt pool;

a drain in said floor including a circumferentially segmented, cold-wall induction-heated guide for draining said melt by gravity;

a plug deployed inside said drain to block discharge of said melt therethrough; and an actuator attached to said plug for withdrawing said plug from said drain to permit draining of said melt therethrough, wherein said guide comprises a downspout having a central orifice, and said plug is elongate and extends upwardly through said downspout in said deployed position, said guide includes an induction heater disposed above said downspout for inductively heating said melt thereabove, said downspout is characterized by the absence of an induction heater therearound.

* * * * *